US010199771B2

(12) United States Patent
Neureiter et al.

(10) Patent No.: US 10,199,771 B2
(45) Date of Patent: Feb. 5, 2019

(54) HIGH-CURRENT PLUG WITH CLIP LOCK

(71) Applicant: ROSENBERGER HOCHFREQUENZTECHNIK GMBH & CO. KG, Fridolfing (DE)

(72) Inventors: Franz Josef Neureiter, Haigermoos (AT); Willem Blakborn, Inzell (DE)

(73) Assignee: ROSENBERGER HOCHFREQUENZTECHNIK; GMBH & CO. KG, Fridolfing (DE)

( * ) Notice: Subject to any disclaimer, the term of this patent is extended or adjusted under 35 U.S.C. 154(b) by 0 days.

(21) Appl. No.: 15/504,485

(22) PCT Filed: Aug. 13, 2015

(86) PCT No.: PCT/EP2015/001676
§ 371 (c)(1),
(2) Date: Feb. 16, 2017

(87) PCT Pub. No.: WO2016/026563
PCT Pub. Date: Feb. 25, 2016

(65) Prior Publication Data

US 2017/0237201 A1 Aug. 17, 2017

(30) Foreign Application Priority Data

Aug. 21, 2014 (DE) ..... 20 2014 006 815 U

(51) Int. Cl.
*H01R 13/52* (2006.01)
*H01R 13/639* (2006.01)
(Continued)

(52) U.S. Cl.
CPC ..... *H01R 13/639* (2013.01); *H01R 13/53* (2013.01); *H01R 13/627* (2013.01)

(58) Field of Classification Search
CPC ..... H01R 13/6271; H01R 13/6276; H01R 13/6277; H01R 13/6278
(Continued)

(56) References Cited

U.S. PATENT DOCUMENTS 5,201,670 A * 4/1993 Watanabe ..... H01R 13/62933 439/372
5,213,533 A * 5/1993 Walden ..... H01R 13/629 439/358
5,769,652 A * 6/1998 Wider ..... H01R 13/6315 439/248
5,850,693 A * 12/1998 Guran ..... H01R 43/205 29/884
(Continued)

FOREIGN PATENT DOCUMENTS

DE 1855747 U 8/1962
DE 3709098 A1 9/1987
(Continued)

*Primary Examiner* — Abdullah Riyami
*Assistant Examiner* — Thang Nguyen
(74) *Attorney, Agent, or Firm* — DeLio, Peterson & Curcio, LLC; Robert Curcio

(57) ABSTRACT

A plug system with a plug connector, such as a high-current plug, and a mating plug connector, such as a high-current socket, for coupling to the plug connector by a lock device which counteracts a withdrawal of the plug connector from the mating plug connector in a locked position (I), wherein the lock device has a lever part which is secured to the plug connector in a pivotal manner and a securing clip which is attached to the lever part in an articulated manner for engaging into an engagement portion of the mating plug connector in the locked position (I).

16 Claims, 3 Drawing Sheets

(51) Int. Cl.
*H01R 13/627* (2006.01)
*H01R 13/53* (2006.01)

(58) Field of Classification Search
USPC ..... 439/352, 358, 271, 587
See application file for complete search history.

(56) References Cited

U.S. PATENT DOCUMENTS

| | | | | | |
|---|---|---|---|---|---|
| 5,919,055 | A * | 7/1999 | Hattori | H01R 13/62938 | 439/310 |
| 7,037,131 | B1 * | 5/2006 | Chen | H01R 13/6215 | 439/362 |
| 7,083,462 | B1 * | 8/2006 | Chen | H01R 13/62966 | 439/362 |
| 8,162,674 | B2 * | 4/2012 | Cho | H01R 12/73 | 362/613 |
| 9,762,002 | B1 * | 9/2017 | Matsumoto | H01R 13/6271 | |
| 2015/0295354 | A1 * | 10/2015 | Morello | H01R 13/639 | 439/352 |
| 2017/0205591 | A1 * | 7/2017 | Takano | H01R 13/6272 | |

FOREIGN PATENT DOCUMENTS

| | | | | | |
|---|---|---|---|---|---|
| DE | 202004019457 | U1 | | 4/2005 | |
| DE | 202007007093 | U1 | * | 5/2007 | H01R 13/639 |
| DE | 202007007093 | U1 | | 10/2008 | |
| EP | 1137111 | A2 | | 9/2001 | |
| FR | 2619473 | A1 | | 2/1989 | |
| JP | H0349172 | | * | 3/1991 | H01R 13/639 |
| JP | H0349172 | | | 5/1991 | |

* cited by examiner

HIGH-CURRENT PLUG WITH CLIP LOCK

BACKGROUND OF THE INVENTION

1. Field of the Invention

The invention relates to a plug system with a plug connector such as a high-current plug and a mating plug connector such as a high-current socket. The plug system has a locking arrangement with a locking device which, in a locking position, prevents a disconnection of the plug connector from the mating plug connector.

In other words, the locking device prevents the plug connector which is connected with the mating plug connector from being pulled out of the mating plug connector contrary to the plugging direction, preventing an unintentional interruption of the current transmission. In the locking position, a contact element of the plug connector is connected in an electrically conductive manner with a mating contact element of the mating plug connector, whereby high currents such as 50 A or more can be conducted via the connection.

2. Description of Related Art

Often, in order to couple a high-current plug with a high-current socket a considerable force is necessary in order to press the plug into the socket or vice versa. Such a pressing force cannot always be applied manually, especially if the position of the plug connection which is to be established is difficult to reach. For this reason, known plug systems are regularly equipped with mechanical force transmission devices in order to facilitate the plugging operation. For example it is known for the plug connector to be connected with the mating plug connector by means of one or more screws, whereby the plug connector is tightened as it is screwed into the mating plug connector.

The force applied to the screw in a circumferential direction by the installer is thus transformed into an axial force acting between the plug connector and the mating plug connector.

However, such a screwing procedure is comparatively laborious and time-consuming.

SUMMARY OF THE INVENTION

In view of the problems described, it is the object of the present invention to provide a simply and quickly couplable plug system consisting of plug connector and mating plug connector which can also be used reliably where high plugging forces need to be applied.

According to the invention, this problem is solved through a further development of the plug systems described above with the features according to the independent claims. Advantageous further developments of the invention are described in the dependent claims.

The above and other objects, which will be apparent to those skilled in the art, are achieved in the present invention which is directed to a plug system comprising a high-current plug connector designed to transmit currents of about 50 A and a high-current mating plug connector for coupling with the plug connector, having a locking device which, in a locking position (I), prevents the plug connector from being pulled off the mating plug connector, wherein the locking device includes a lever part attached swivelably to the plug connector and a securing clip articulated thereto designed to engage in an engaging section of the mating plug connector in the locking position (I), by a pre-tensioning part, yielding in an axial direction, which in the locking position (I) acts between the plug connector and the mating plug connector, and which can be compressed in an axial direction when the locking device is moved into the locking position (I).

The securing clip is designed to pull the mating plug connector in the direction of the plug connector as a result of the lever part being swiveled into the locking position (I).

The lever part may include an operating section at its free end and the securing clip is attached to the lever part at a hinge point which is further removed from the free end of the lever part than the end of the lever part which is attached swivelably to the plug connector.

In the locking position (I), the securing clip overlaps a projection such as a nose projecting radially from the mating plug connector. The projection is equipped with a guide surface facing the plug connector such as a sloping surface, inclined obliquely towards the outside, designed to guide the front end of the securing clip to the engaging section and/or a contact surface oriented transversely to the guide surface, approximately perpendicular to the plugging direction (R) and facing away from the plug connector.

The mating plug connector has an ejection surface opposite the engaging section, which is designed to push the plug connector away from the mating plug connector as a result of a swiveling of the lever part from the locking position (I) into an opening position (II).

The plug connector also includes a securing element limiting an outward radial swiveling of the securing clip, with which a supporting region of the securing clip comes into contact during a swiveling of the lever part.

The yielding pre-tensioning part is a seal, wherein the seal may be in the form of a sealing ring, preferably substantially L-formed in cross section, accommodated in a peripheral recess on the plug side of the plug connector, wherein, in the locking position (I), the sealing ring interacts in a sealing manner with a projecting annular surface of the mating plug connector.

The plug system may further include a securing device which can be moved from a release position (III), in which it enables a swiveling movement of the lever part, into a securing position (IV), in which it blocks a swiveling movement of the lever part, starting out from the locking position (I), and vice versa.

The securing device has a blocking bar, arranged so as to be displaceable in an axial direction, which in the locking position (IV) obstructs a swivel path of the lever part.

In the locking position (I), the blocking bar is forced into the securing position (IV) through a guide surface of the mating plug connector, in particular through the sloping surface of the projection (52).

In a second aspect, the present invention is directed to a plug connector including a locking device which, in a locking position (I), prevents the plug connector from being pulled off a mating plug connector, wherein the locking device includes a lever part attached swivelably to the plug connector and a securing clip articulated thereto designed to engage in an engaging section of the mating plug connector in the locking position (I), by a pre-tensioning part, yielding in an axial direction, which in the locking position (I) acts between the plug connector and the mating plug connector, and which can be compressed in an axial direction when the locking device is moved into the locking position (I).

In a third aspect, the present invention is directed to a mating plug connector including an engaging section for engaging a securing clip articulated to a plug connector, the mating plug connector forming with the plug connector a pre-tensioning part, yielding in an axial direction, which in a locking position (I) acts between the plug connector and the mating plug connector, and which can be compressed in an axial direction when a locking device on the plug connector is moved into the locking position (I).

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
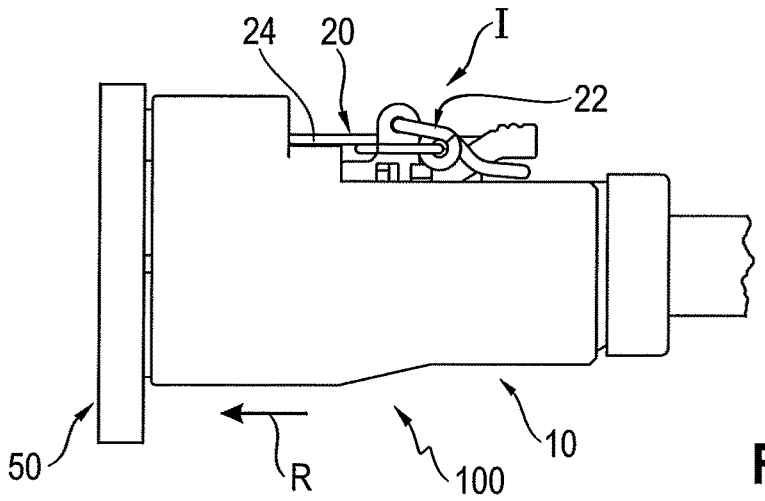
FIG. 1 shows a schematic side view of a plug system according to the invention in the locking position I.

In describing the preferred embodiment of the present invention, reference will be made herein to FIGS. 1-8 of the drawings in which like numerals refer to like features of the invention.

The plug system according to the invention is characterized in that the locking device has a lever part attached swivelably to the plug connector and a securing clip articulated thereto designed to engage in an engaging section of the mating plug connector in the locking position.

Since, in the locking position, the securing clip engages in the engaging section of the mating plug connector, it is not possible, in the locking position, to pull the plug connector and mating plug connector apart contrary to the plugging direction. Instead, in order to enable a disconnecting movement, the securing clip must first be disengaged from the engaging section. This can be effected by means of a swiveling movement of the lever part to which the securing clip is articulated. The lever part is arranged swivelably on a base part of the plug connector, and the securing clip is arranged on said lever part, again swivelably in relation to the lever part.

The invention is based on the knowledge that a transmission of force by means of a simple lever is particularly advantageous in order to connect the plug connector and mating plug connector. Other than in the case of a transmission of force by means of screws, this does not require any time-consuming screwing procedure, simply a simple and quickly performable swiveling operation of the lever part. The force required in order to connect the plug connector and mating plug connector can be adjusted by defining the physical positioning of the securing clip on the lever part and the length of the lever part. A swiveling movement of the lever part away from the mating plug connector thereby leads to a displacement of the securing clip attached thereto, both axially and away from the mating plug connector (or in the direction of the base part of the plug connector), so that the mating plug connector is pulled in the direction of the plug connector when the securing clip engages in the engagement point. Conversely, a swiveling movement of the lever part in the direction of the mating plug connector leads to a displacement of the front end of the securing clip, both axially and in the direction of the mating plug connector (or away from the base part of the plug connector) so that, with a suitably shaped engagement point, the securing clip can be disengaged from the engagement point or the plug connection can actually be actively forced apart, whereupon the plug connector can be disconnected from the mating plug connector without needing to apply a great amount of force.

In other words, the securing clip can be designed so as to pull the mating plug connector in the direction of the plug connector through swiveling of the lever part into the locking position.

The following steps are carried out in order to connect the plug connector with the mating plug connector: first, the lever part is swiveled in the direction of the mating plug connector, so that the securing clip extends far in the direction of the mating plug connector. As a result, when the plug connector is introduced into the mating plug connector the securing clip is already arranged at the height of the engagement point before the plug connector has reached its final axial position. The securing clip is articulated to the lever part, so that, through the force of gravity, it automatically engages in the engaging section, which preferably comprises a recess on the outside of the mating plug connector. The lever part is then swiveled away from the mating plug connector, with the securing clip thereby coming into contact with a contact surface of the engaging section running transversely to the plugging direction. As a result, as the lever part swivels further, the plug connector and the mating plug connector are pulled together. The final relative axial position of plug connector and mating plug connector is achieved when the lever part has completely folded over and in this position preferably lies closely against the plug connector. The locking position is achieved.

A pre-tensioning part forcing the mating plug connector away from the plug connector, by means of which the securing clip can be pressed into the locking position on the engaging section, preferably acts between the plug connector and the mating plug connector.

In terms of achieving a user-friendly operability of the lever part, it has proved expedient for the lever part to have at its free end an operating section, which can be designed in the form of a handle and/or a cross member or similar which can be grasped with the fingers. Alternatively or additionally, the securing clip is attached to the lever part at a hinge point which is further removed from the free end of the lever part than the end of the lever part which is attached swivelably to the plug connector. The force transmission ratio is adjusted by means of the positioning of the hinge point on the lever part. Preferably, the distance between the hinge point and the end of the lever part fixed to the plug connector amounts to less than 35%, in particular less than 25% of the distance between the hinge point and the free end or the operating section of the lever part.

A simple and reliable connection of the plug connector with the mating plug connector can be ensured in that, in the locking position, the securing clip overlaps a projection such as a nose projecting radially from the mating plug connector. The engagement point is located in a recess behind the projection, viewed from the plug connector.

The connection operation can be further simplified in that the projection is equipped with a guide surface facing the plug connector such as a sloping surface, inclined obliquely towards the outside, and designed to guide the securing clip to the engaging section. Alternatively or additionally, the projection can form a contact surface oriented transversely to the guide surface, in particular roughly perpendicular to the plugging direction and facing away from the plug connector, which forms the engaging section.

A cross member running transversely to the plugging direction can be arranged at the front end of the securing clip which, when the plug connector is plugged into the mating plug connector, falls into the recess formed behind the projection and when the lever part is tightened into the locking position is pressed against the contact surface of the projection. Alternatively, an engagement projection or similar, at least in sections complementary in form to the engagement point, can be formed on the front end of the securing clip.

According to a particularly important aspect of the invention, the mating plug connector has an ejection surface opposite the engaging section which is designed to push the plug connector away from the mating plug connector as a result of a swiveling of the lever part from the locking position into an opening position. The distance between the ejection surface and the contact surface of the projection opposite this preferably amounts to more than 2 mm and less than 2 cm. When, starting out from the locking position, the lever part is swiveled in the direction of the mating plug connector, the front end of the securing clip comes to rest against the ejection surface, so that a further swiveling of the lever part leads to a repellent force acting between the plug connector and the mating plug connector. When the lever part is swiveled completely in the direction of the mating plug connector and is in the opening position, the plug connector can easily be pulled out of the mating plug connector. The swivel angle between the locking position and the opening position of the lever part preferably amounts to more than 90° and less than 180°, in particular between 120° to 150°.

In terms of achieving a further improvement in user-friendliness, it has proved advantageous for the plug connector to have a securing element limiting an outward radial swiveling of the securing clip. The securing element can be designed in the form of a cover extending in an axial direction and, at least in sections, covering the securing clip. The securing element ensures that the securing clip always extends substantially in an axial direction and faces the mating plug connector. In particular, the securing element prevents the securing clip from folding over completely as well as preventing the securing clip from springing off the contact surface and/or off the ejection surface in an uncontrolled manner under the effect of tension and/or pressure. Preferably, the securing element permits the securing clip to swivel around the lever part by a maximum of 30° or less, in particular a maximum of 15° or less. It has proved particularly advantageous if, on swiveling of the lever part, the securing element comes into contact, at least in sections, with a supporting region of the securing lever, since in this way the movement of the securing clip can be guided in a more stable manner.

The effectiveness of the clip lock can be further improved in that a pre-tensioning part acting, in the locking position, between the plug connector and the mating plug connector and yielding in an axial direction is provided which can be designed as a seal part, in particular as an elastic axial seal. In the locking position, the pre-tensioning part forces the mating plug connector away from the plug connector, thus pressing the securing clip against the contact surface of the engaging section. As a result, the locking device is held in a stable position when the lever part is located in the locking position. The pre-tensioning part is compressed elastically in an axial direction when the locking device is moved into the locking position and supports the disconnection procedure when the lever part is moved into the opening position.

The elastic and compressible axial seal part is particularly important if the plug connector is exposed to vibrations, since these can be absorbed by the seal part acting as a vibration damper, so that damage to the plug connector and/or the mating plug connector can be prevented.

In a particularly preferred embodiment of the invention, the seal part is a sealing ring which is substantially L-formed in cross section. A section of the L-formed sealing ring acting axially between the plug connector and the mating plug connector forms the pre-tensioning element described above and a fluid seal is provided through a section of the sealing ring acting radially between the plug connector and the mating plug connector. The L-formed sealing ring can be accommodated in a peripheral recess on the plug side of the plug connector whereby, in the locking position, the sealing ring interacts in a sealing manner with a projecting annular surface of the mating plug connector, against which the sealing ring rests axially.

An unintentional opening of the locking device can be prevented through a securing device which can be moved from a release position, in which it enables a swiveling movement of the lever part, into a securing position, in which it blocks a swiveling movement of the lever part, starting out from the locking position, and vice versa. The locking device can be locked in the locking position with the aid of the securing device.

In a particularly preferred embodiment of the invention, the securing device has a blocking part, such as a blocking bar, arranged so as to be displaceable in an axial direction, which in the locking position obstructs a swivel path of the lever part and thus prevents a movement of the lever part from the locking position into the opening position.

In terms of achieving a particularly reliable securing effect of the securing device it has proved expedient that, in the locking position, the blocking bar is forced into the securing position through a guide surface of the mating plug connector, in particular through the sloping surface of the projection, since it slides off under the action of gravity. The guide surface of the mating plug connector thus serves, on the one hand, to guide the front end of the securing clip to the engaging section and on the other hand to move the blocking bar automatically into the securing position. Before disconnecting the plug connection, the blocking bar must therefore first be moved in the direction of the mating plug connector in order to clear the swivel path of the lever part.

The invention also relates to a plug connector of a plug system according to the invention such as a high-current plug. Such a plug connector is characterized by a lever part attached swivelably thereto and a securing clip, in turn articulated on said lever part, designed to engage in an engaging section of a mating plug connector when in a locking position. The plug connector according to the invention can also exhibit the features described above individually or in combination.

The invention also relates to a mating plug connector of a plug system according to the invention such as a high-current socket. Such a mating plug connector is characterized in particular by an engaging section into which the securing clip of a plug connector according to the invention can engage. The engaging section is preferably formed by a recess or contact surface formed behind a projection. The mating plug connector according to the invention can also exhibit the features described above individually or in combination.

FIG. 1 shows a side view of a plug system 100 according to the invention, consisting of a plug connector 10 and a mating plug connector 50. The plug connector 10 is a high-current plug designed to transmit currents of more than 50 A, and the mating plug connector 50 is a high-current socket.

The plug system is shown in a locking position I, in which the plug connector 10 is plugged, in a plugging direction R, completely into the mating plug connector, so that the inner contacts of the high-current plug make electrical contact with the inner contacts of the high-current socket. In this locking position I, which is represented in cross section in FIG. 2, a front end of a securing clip 24 of the plug connector 10 engages in an engaging section 26 of the mating plug connector 50. A front end of the securing clip 24 thereby lies against a contact surface 56 of a projection 52 which faces away from the plug connector 10, so that the plug connector cannot be pulled away from the mating plug connector in a direction contrary to the plugging direction R. The securing clip 24 engaging in the engaging section 26 thus forms a locking device 20 preventing the plug connector from being pulled out of the mating plug connector.

The locking device 20 is also designed to pull the plug connector 10 in the direction of the mating plug connector 50 in order to facilitate the plugging operation. For this purpose, the locking device 20 has a lever part 22 attached swivelably to the plug connector 10 with a hinge point 23, whereby the securing clip 24 is connected swivelably with the lever part at the hinge point 23 (see also FIG. 8 in particular). The swivel axis of the lever part 24 around the base part of the plug connector 10 runs parallel to the swivel axis of the securing clip around the lever part 24, whereby the distance between the two swivel axes is less than the distance between the hinge point 23 and the free end 25 of the lever part 24. Depending on the desired force transmission ratio, the hinge point 23 can also be arranged in a different position on the lever part, for example even closer to the end 21 fixed to the plug connector 10, in order to further reduce the force necessary in order to swivel the lever part 22.

The projection 52 over which the securing clip 24 latches in the locking position I has, on the one hand, the contact surface 56 and, on the other hand, a guide surface in the form of a sloping surface 54 facing the plug connector 10, by means of which the securing clip 24 is guided to the engaging section 26 during the connection operation.

Figure 2:
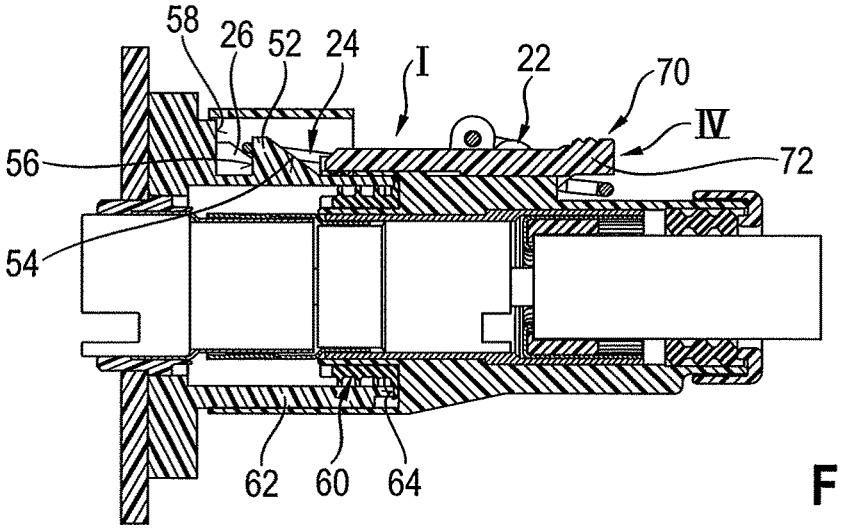
FIG. 2 shows a sectional view of the plug system according to the invention in the locking position I.
Figure 3:
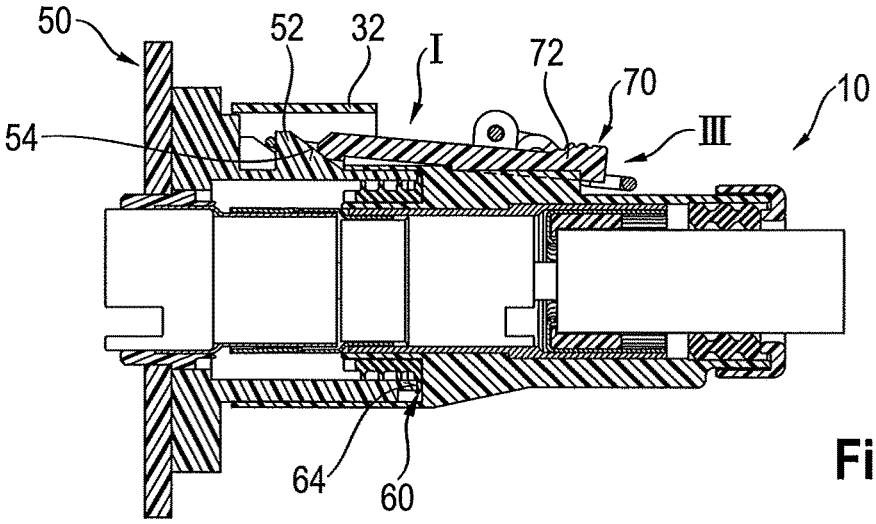
FIGS. 3 to 7 show different relative positions which the plug system represented in FIG. 2 assumes as the plug connector is pulled out of the mating plug connector, in each case in a sectional view.
Figure 4:
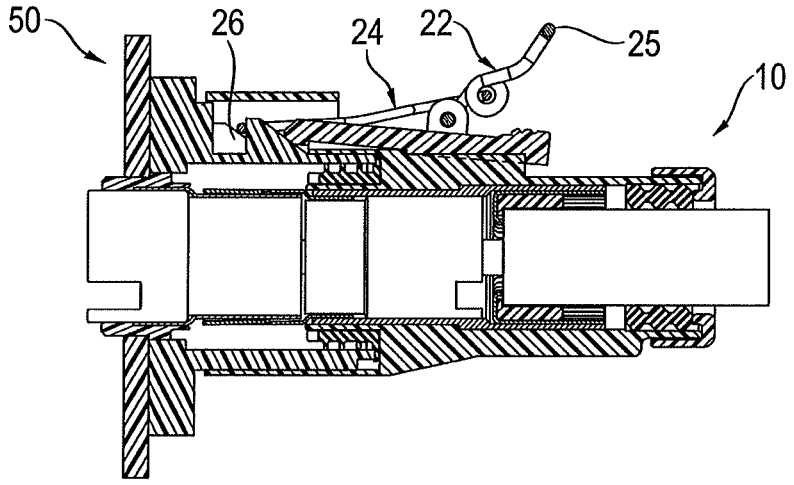

The plug connector 10 also has a securing device 70 with a blocking bar 72, mounted so as to be displaceable in an axial direction, which can be moved from the release position III illustrated in FIG. 3 into the securing position IV illustrated in FIG. 4 and vice versa. As illustrated particularly clearly in FIG. 2, in the securing position IV the blocking bar 72 obstructs a swivel path of the lever part 22, so that the lever part 22 cannot be swiveled in a counter-clockwise direction from the illustrated locking position IV into the opening position III. This ensures that the plug connection cannot be accidentally disconnected. FIG. 3 shows that, in the release position III, the front end of the blocking bar 72, viewed in the plugging direction R, lies against the sloping surface 54 of the projection 52 and as a result slides off in the direction of the securing position IV illustrated in FIG. 2. This leads to an automatically locking securing device 70. The blocking bar 72 must be actively displaced in the direction of the mating plug connector 50 by the installer before a swiveling of the lever part 22 is possible.

Particularly important according to the invention is the pre-tensioning part 60, accommodated in a peripheral recess on the plug side of the plug connector 10, which in the embodiment shown is in the form of an elastic ring seal with L-formed cross-section. This ring seal has an axial sealing section acting, in the locking position I, between a projecting annular surface 64 of the mating plug connector 50 and the base of the recess in the plug connector 10, which can be compressed during the plugging operation of the plug connector 10, so that in the locking position I the securing clip 24 is pressed against the contact surface 56 and cannot swivel upwards out of the engaging section 26. The seal part 60 also provides a particularly good vibration damping. A section of the sealing ring acting radially between the plug connector and the mating plug connector seals the plug connection in a fluid-tight manner.

Figure 5:
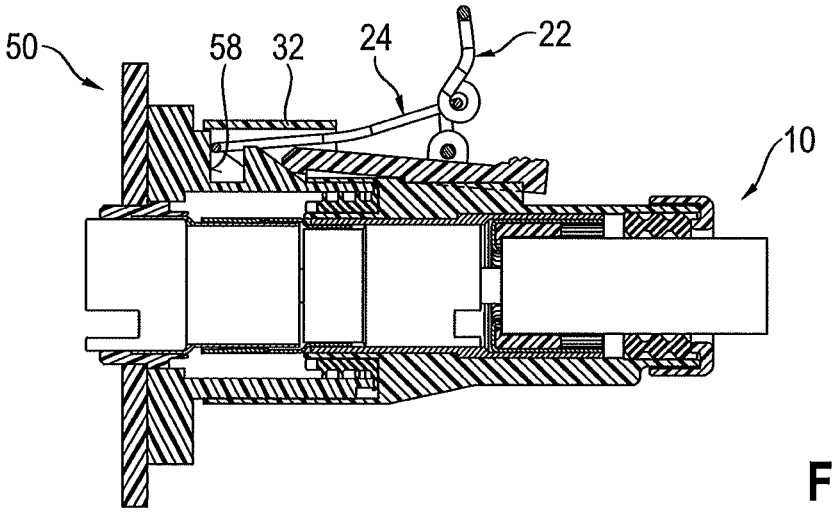
Figure 6:
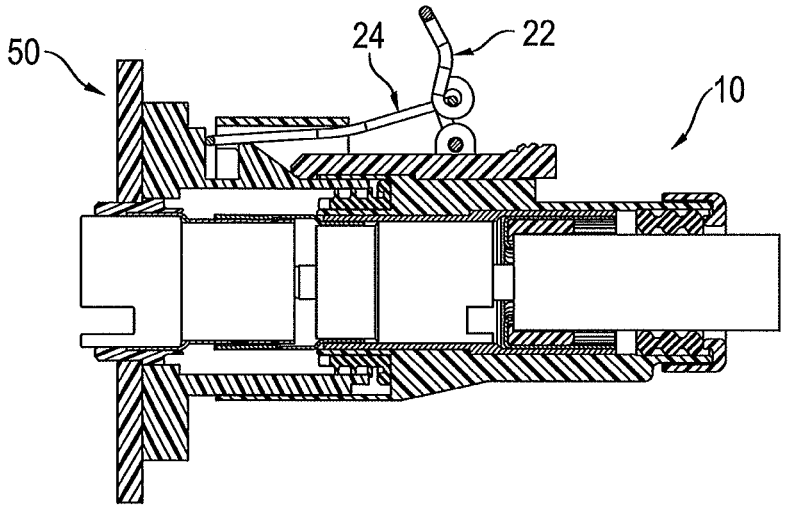
Figure 7:
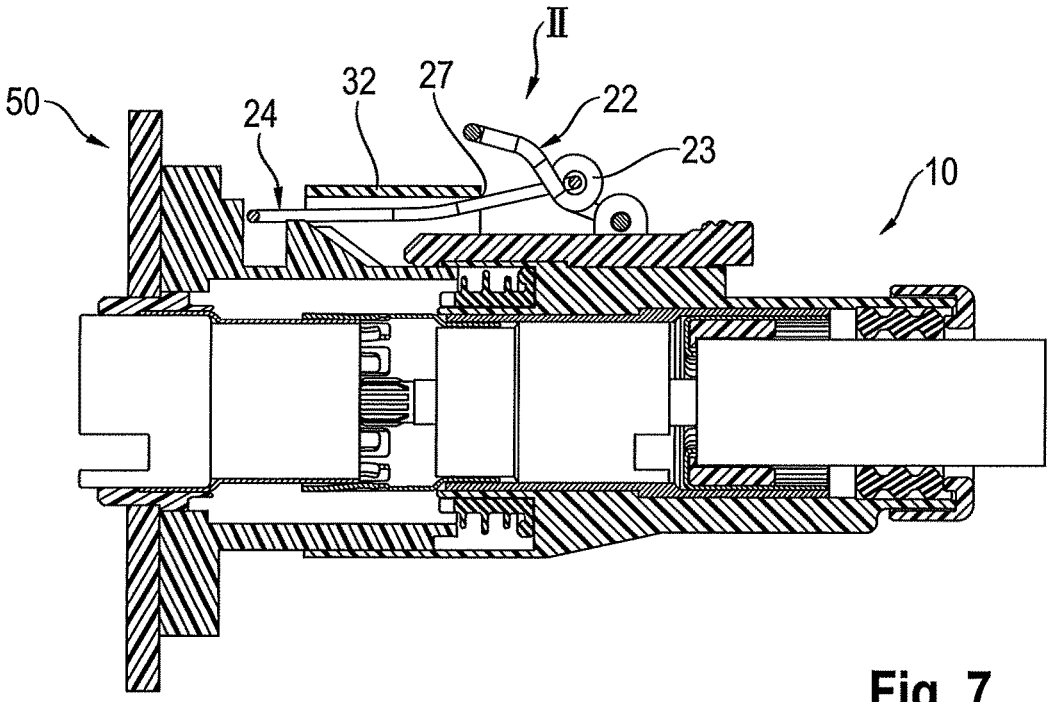

Opposite the contact surface 56 lies an ejection surface 58, running roughly perpendicular to the plugging direction R, which faces the plug connector 10 and which can be contacted by the securing clip 24, so that the plug connector 10 can be pressed out of the mating plug connector 50 through a swiveling of the lever part 22 (see in particular FIG. 5 to FIG. 7).

A securing element 32, covering sections of the securing clip 24, which is designed in the form of a substantially flat cover surface at a small radial distance from the vertex of the projection 52, prevents the securing clip from "folding over" and at the same time ensures that the securing clip 24 at all times projects in the direction of the mating plug connector 50 and is thus "ready to engage".

A procedure for disconnecting the connected plug system 100 is described by way of example in the following. The procedure for connection substantially proceeds in the reverse order.

Starting out from the locking position I shown in FIG. 2, the blocking bar 70 is first displaced in the direction of the mating plug connector 50 into the release position III, so that it no longer obstructs the swivel path of the lever part 22 (see FIG. 3).

Starting out from the release position III shown in FIG. 3, the lever part is raised by its free end 25, which can be equipped with a handle. The first part of the swiveling movement of the lever part 22 is supported through the relaxing sealing ring 60 (see FIG. 4).

Starting out from the position shown in FIG. 4, the lever part 22 is swiveled further in a counter-clockwise direction in the direction of the mating plug connector 50, whereby the securing clip 24 becomes detached from the contact surface 56 and moves in the direction of the ejection surface 58 until it lies against this (see FIG. 5).

In order to swivel the lever part 22 further, the installer must apply a lever force in order to push the plug connector 10 away from the mating plug connector 50 contrary to the plugging direction R (see FIG. 6).

The lever part 22 is swiveled as far as possible in a counter-clockwise direction (see FIG. 7).

Figure 8:
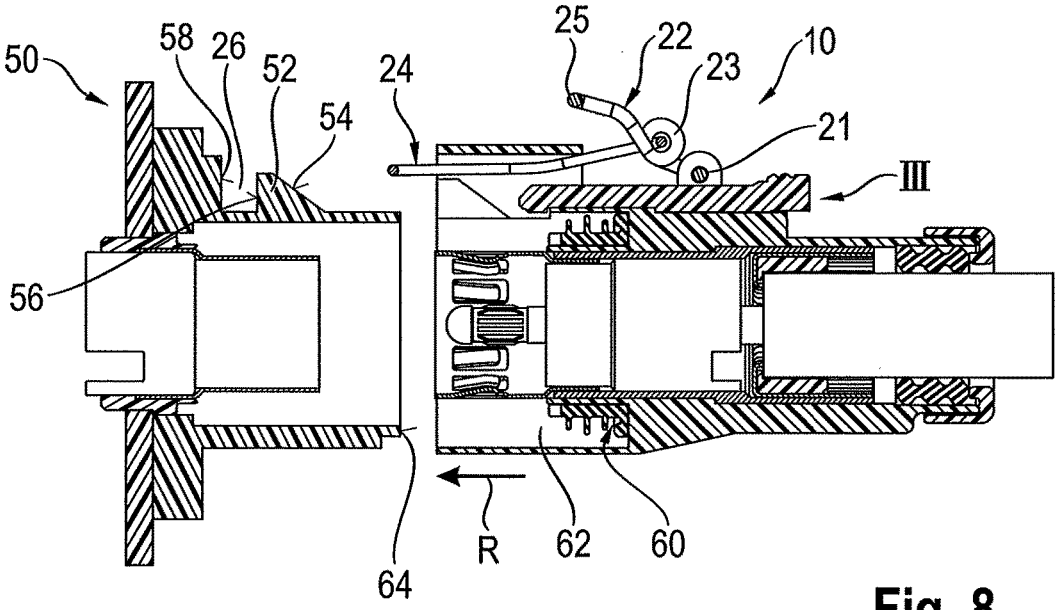
FIG. 8 shows a sectional view of the plug system represented in FIG. 2 in an opening position II, in which the plug connector is completely disconnected from the mating plug connector.

The plug connector 10 can now be pulled off the mating plug connector 50 (see FIG. 8).

LIST OF REFERENCE NUMBERS

10 plug connector
20 locking device
21 end of the lever part fixed to the plug connector

22 lever part
23 hinge point
24 securing clip
25 free end of the lever part
26 engaging section
27 supporting region
32 securing element
50 mating plug connector
52 projection
54 sloping surface
56 contact surface
58 ejection surface
60 seal part
62 recess
64 annular surface
70 securing device
72 blocking bar
100 plug system
R plugging direction
I locking position
II opening position
III release position
IV securing position While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug system comprising a high-current plug connector designed to transmit currents of about 50 A or more and a high-current mating plug connector for coupling with the plug connector, having a locking device which, in a locking position (I), prevents the plug connector from being pulled off the mating plug connector, wherein the locking device includes a lever part attached swivelably to the plug connector and a securing clip articulated thereto designed to engage in an engaging section of the mating plug connector in the locking position (I), the plug system further comprising a pre-tensioning part, yielding in an axial direction, which in the locking position (I) acts between the plug connector and the mating plug connector, and which can be compressed in an axial direction when the locking device is moved into the locking position (I), wherein the plug connector includes a securing element limiting an outward radial swiveling of the securing clip, with which a supporting region of the securing clip comes into contact during a swiveling of the lever part.

2. The plug system of claim 1, wherein the securing clip is designed to pull the mating plug connector in the direction of the plug connector as a result of the lever part being swiveled into the locking position (I).

3. The plug system of claim 1, wherein the lever part includes an operating section at its free end and the securing clip is attached to the lever part at a hinge point which is further removed from the free end of the lever part than the end of the lever part which is attached swivelably to the plug connector.

4. The plug system of claim 1, wherein, in the locking position (I), the securing clip overlaps a projection such as a nose projecting radially from the mating plug connector.

5. The plug system of claim 4, wherein the projection is equipped with a guide surface facing the plug connector such as a sloping surface, inclined obliquely towards the outside, designed to guide the front end of the securing clip to the engaging section and/or a contact surface oriented transversely to the guide surface, approximately perpendicular to the plugging direction (R) and facing away from the plug connector.

6. The plug system of claim 1, wherein the mating plug connector has an ejection surface opposite the engaging section which is designed to push the plug connector away from the mating plug connector as a result of a swiveling of the lever part from the locking position (I) into an opening position (II).

7. The plug system of claim 1, wherein the yielding pre-tensioning part is a seal.

8. The plug system of claim 7, wherein the seal is a sealing ring, preferably substantially L-formed in cross section, accommodated in a peripheral recess on the plug side of the plug connector, wherein, in the locking position (I), the sealing ring interacts in a sealing manner with a projecting annular surface of the mating plug connector.

9. The plug system of claim 1, including a securing device which can be moved from a release position (III), in which it enables a swiveling movement of the lever part, into a securing position (IV), in which it blocks a swiveling movement of the lever part, starting out from the locking position (I), and vice versa.

10. The plug system of claim 9, wherein the securing device has a blocking bar, arranged so as to be displaceable in an axial direction, which in the locking position (IV) obstructs a swivel path of the lever part.

11. The plug system of claim 10, wherein, in the locking position (I), the blocking bar is forced into the securing position (IV) through a guide surface of the mating plug connector, in particular through the sloping surface of the projection (52).

12. The plug system of claim 3, wherein, in the locking position (I), the securing clip overlaps a projection such as a nose projecting radially from the mating plug connector.

13. The plug system of claim 5, wherein the mating plug connector has an ejection surface opposite the engaging section which is designed to push the plug connector away from the mating plug connector as a result of a swiveling of the lever part from the locking position (I) into an opening position (II).

14. The plug system of claim 13, wherein the plug connector includes a securing element limiting an outward radial swiveling of the securing clip, with which a supporting region of the securing clip comes into contact during a swiveling of the lever part.

15. The plug system of claim 7, wherein the yielding pre-tensioning part is an elastic axial seal.

16. The plug system of claim 14, including a securing device which can be moved from a release position (III), in which it enables a swiveling movement of the lever part, into a securing position (IV), in which it blocks a swiveling movement of the lever part, starting out from the locking position (I), and vice versa.

* * * * *